US006348025B1

(12) United States Patent
Schönenberger

(10) Patent No.: US 6,348,025 B1
(45) Date of Patent: Feb. 19, 2002

(54) MOVING WALKWAY DEVICE

(75) Inventor: Willi Schönenberger, Schoenenberg (CH)

(73) Assignee: Woodway AG International, Schoenenberg (CH)

( * ) Notice: Subject to any disclaimer, the term of this patent is extended or adjusted under 35 U.S.C. 154(b) by 0 days.

(21) Appl. No.: 09/242,083

(22) PCT Filed: Sep. 2, 1997

(86) PCT No.: PCT/EP97/04781

§ 371 Date: Feb. 23, 2000

§ 102(e) Date: Feb. 23, 2000

(87) PCT Pub. No.: WO98/10839

PCT Pub. Date: Mar. 19, 1998

(30) Foreign Application Priority Data

Sep. 12, 1996 (DE) ..... 296 15 912 U

(51) Int. Cl.[7] ..... A63B 22/00
(52) U.S. Cl. ..... 482/54; 198/334
(58) Field of Search ..... 482/51, 54; 198/334, 198/335, 792, 465.3, 803.2, 833, 324

(56) References Cited

U.S. PATENT DOCUMENTS

| | | | | |
|---|---|---|---|---|
| 1,743,995 A | | 1/1930 | Bartlett | |
| 2,813,604 A | | 11/1957 | Koepnick et al. | |
| 4,635,928 A | | 1/1987 | Ogden et al. | |
| 4,655,447 A | | 4/1987 | Dubrinsky et al. | |
| 4,842,266 A | | 6/1989 | Sweeney, Sr. et al. | |
| 5,000,440 A | | 3/1991 | Lynch | |
| 5,431,612 A | | 7/1995 | Holden | |
| 5,470,293 A | | 11/1995 | Schönenberger | |
| 5,571,254 A | * | 11/1996 | Saeki et al. | 198/334 |
| 5,577,598 A | | 11/1996 | Schoenenberger | |
| 5,603,677 A | | 2/1997 | Sollo | |
| 5,788,606 A | | 8/1998 | Rich | 482/27 |
| 6,065,583 A | * | 5/2000 | Hoashi | 198/334 |

FOREIGN PATENT DOCUMENTS

| | | |
|---|---|---|
| DE | 1 650 657 | 11/1970 |
| DE | 2 151 933 | 8/1973 |
| DE | 25 03 118 B2 | 4/1976 |
| DE | 26 09 043 A1 | 9/1977 |
| DE | 38 35 979 A1 | 4/1990 |
| DE | 42 38 252 C2 | 5/1994 |
| EP | 0 364 992 A2 | 4/1990 |
| FR | 718-485 | 1/1932 |
| FR | 2 252 108 | 6/1975 |
| GB | 885427 | 12/1961 |
| GB | 2 152 825 A | 8/1985 |
| SU | 610 746 | 6/1978 |
| WO | WO 93/14733 | 8/1993 |
| WO | WO 96/09094 | 3/1996 |

* cited by examiner

*Primary Examiner*—Glenn E. Richman
(74) *Attorney, Agent, or Firm*—Susan D. Betcher; Seed Intellectual Property Law Group PLLC

(57) ABSTRACT

A treadmill with at least one endless belt provided with a plurality of tread lamellae and guided around two deflection pulleys which are arranged one behind the other with parallel axes, the deflection pulleys being smooth in the area where they are in contact with the belt and at least one belt being implemented as a flat belt. Each tread lamella is provided with at least one engagement element projecting from the lower surface of the tread lamella. In addition, at least two stabilizers are provided, which are connected to the deflection pulley such that they are secured against rotation relative thereto, a stabilizer of this kind being in engagement with an engagement element on the lower surface of a tread lamella when the circumferential area of the deflection pulley, which rotates in synchronism with the stabilizer, is in contact with the at least one belt, and at least one stabilizer being always in engagement with the engagement element of a tread lamella.

13 Claims, 5 Drawing Sheets

TEILSCHNITT B-B

TEILSCHNITT A-A

MOVING WALKWAY DEVICE

The present invention refers to a treadmill comprising at least one endless belt provided with a plurality of tread lamellae and guided around two deflection pulleys which are arranged one behind the other with parallel axes, said deflection pulleys being smooth in the area where they are in contact with the belt and said at least one belt being implemented as a flat belt, according to the generic clause of claim 1.

DE 25 03 118 B2 discloses a treadmill for physical training in the case of which an endless toothed belt is guided around two parallel deflection pulleys which are arranged one behind the other. This toothed belt is in engagement with complementary toothed rims on the deflection pulleys and can be driven by one or by both deflection pulleys. The toothed belt has attached thereto a plurality of tread lamellae-serving as a running surface between the deflection pulleys. In the area of the running surface, the tread lamellae are additionally supported by a supporting roller arrangement (cf. FIG. 3 of the cited Offenlegungsschrift DE 25 03 118 B2).

The transmission of force via toothed deflection pulleys and toothed belts generates an unpleasant, loud noise, which is found annoying when the treadmill is in operation. In addition a high degree of wear has to be reckoned with in the area of the teeth of the toothed belt.

In DE 42 38 252 C2, a treadmill is described, in which the transmission of force is essentially effected by means of a smooth portion of the respective deflection pulley to a smooth portion of the endless belt. The respective deflection pulley is additionally provided with a toothed-rim portion which is in engagement with a toothed-rim area (cf. FIG. 2 of the cited patent DE 42 38 252 C2). Since the transmission of force takes place essentially via the smooth portion of the deflection pulleys and the sliding-belt portion of the endless belt, less noise is generated when the treadmill is in operation.

However, due to the toothed-belt portion which is in engagement with the toothed-disk portion of the deflection pulleys, the noise generated when these components are in engagement is still rather loud and unpleasant. In addition, the production of the deflection pulleys, which consist of a sliding disk portion and a toothed-rim portion, and of the endless belt, which consists of toothed-belt portion and a sliding-belt portion, is complicated and expensive.

Offenlegungsschrift DE 25 03 118 B2, which has already been cited, additionally describes an arrangement in the case of which an endless belt is guided around two deflection pulleys, the belt being not implemented as a toothed belt. The noise generated by the toothed-belt/toothed-rim engagement is prevented in this way. The endless belt has secured thereto tread lamellae by means of suitable fastening pieces; these tread lamellae are, in turn, intended to form the running surface between the deflection pulleys. In the area of the running surface, the tread lamellae are supported by a suitable supporting roller arrangement.

However, in the case of such a deflection-pulley/belt arrangement, where said deflection pulleys and said belt have smooth surfaces, the danger exists that slip may occur between the driven deflection pulley and the belt. This makes the reproducibility of parameters inaccurate, said parameters being e.g. a speed measurement of the treadmill or a measurement of the distance which is to be simulated by the moving treadmill. In addition such slip may have the effect that the tread lamellae do not move parallel to one another.

Starting from this prior art, it is the object of the present invention to provide a treadmill which is adapted to be operated with the least possible noise, the movemement of the tread lamellae being stabilized in such a way that slip between the belt unit and the deflection pulley is prevented and the arrangement being economy-priced and reliable.

This object is achieved by a treadmill having the features of the characterizing clause of claim 1.

According to the present invention, each tread lamellae is provided with at least one engagement element projecting from the lower surface of said tread lamella, and at least two stabilizers are provided, which are connected to the deflection pulley such that they are secured against rotation relative thereto, a stabilizer of this kind being in engagement with an engagement element on the lower surface of a tread lamella when the circumferential area of the deflection pulley, which rotates in synchronism with the stabilizer, is in contact with the at least one belt, and at least one stabilizer being always in engagement with an engagement element.

In the treadmill according to the present invention, the force is transmitted without any toothed-belt/toothed-rim engagement. A possibly occuring slip is prevented by the existence of stabilizers. At least one of these stabilizers is always in engagement with an engagement element. Since the stabilizers are connected to the deflection pulley such that they are secured against rotation relative thereto, a 100% reproducibility of the speed of the treadmill in correspondence with the deflection pulleys is guaranteed in this way. Since toothed rims and toothed belts can be dispensed with, low-noise operation is guaranteed.

In accordance with a preferred embodiment, the deflection pulley comprises at least two deflection disks which are fixedly connected to a deflection shaft, and at least two corresponding belts are provided, which are guided on the at least two deflection disks, the at least one engagement element projecting from the lower surface of a tread lamella being arranged between the belts and the at least two stabilizers between the deflection disks.

This kind of arrangement reduces the amount of material that has to be used for the treadmill and permits a compact arrangement of the stabilizers.

In this embodiment, the tread lamellae in the area between the belts can have a T-shaped cross-section, the stem at the bottom of this T constituting the engagement element.

Such a cross-section of the tread lamellae prevents the lamellae from bending when a load is applied thereto. The engagement elements therefore fulfill a support function and represent respective engagement surfaces.

According to a first embodiment, the stabilizers extend radially and have such a length that they are adapted to be brought into engagement with the engagement elements of the tread lamellae.

It will be advantageous to provide at least four stabilizers, at least two respective ones of said stabilizers being arranged in spaced relationship with each other at the same angular position relative to the axis of the deflection pulleys.

Such an arrangement permits the individual stabilizers to be implemented as narrow elements, and this will save weight and material and reduce the noise produced when the stabilizers are brought into engagement with the engagement elements. Due to the fact that the stabilizers are arranged in pairs at identical angular positions, a parallel orientation of the tread lamellae is nevertheless guaranteed.

According to a second embodiment, the stabilizers extend from a deflection disk parallel to the deflection shaft on a radius of the deflection disk which permits an engagement of the stabilizers with the engagement elements on the tread lamellae.

This embodiment permits the amount of material used and the weight to be reduced still further.

According to a preferred arrangement of the second embodiment, a respective stabilizer on a deflection disk is arranged in opposed relationship with a second stabilizer on the other deflection disk.

An arrangement of this kind permits a compact structural design, without the stabilizers being visible from outside.

In accordance with another structural design of the second embodiment, the deflection disks can be interconnected by the stabilizers.

This means that the whole arrangement is stabilized still further.

In accordance with an advantageous embodiment, it is then possible to provide no central shaft in the area between the deflection disks; hence, material and weight will be saved again.

In the embodiments described, it will be advantageous when, in the area of engagement with the engagement elements on the lower surfaces of the tread lamellae, the stabilizers consist of an elastic material or are provided with an elastic coating. It will also be advantageous when the engagement elements on the lower surfaces of the tread lamellae are provided with a surface of elastic material. These measures serve to reduce the noise still further.

In the case of all embodiments, it will be advantageous when, in the circumferential direction of the deflection pulley, the size of the engagement areas of the stabilizers corresponds substantially to the distance between two engagement elements of two neighbouring tread lamellae, when these two tread lamellae are positioned on the deflection pulley.

A structural design of this kind guarantees a stabilization of the treadmill movement in both directions and permits an even more precise operation in this way.

It will also be advantageous when the stabilizers are arranged in pairs, the two stabilizers of one pair being arranged at opposite positions with regard to the axis of the deflection pulley.

In the following, the various embodiments of the present invention will be explained in detail on the basis of the drawings enclosed, in which FIG. 1 shows the deflection pulley area of a treadmill according to the first embodiment of the present invention;

Figure 1:
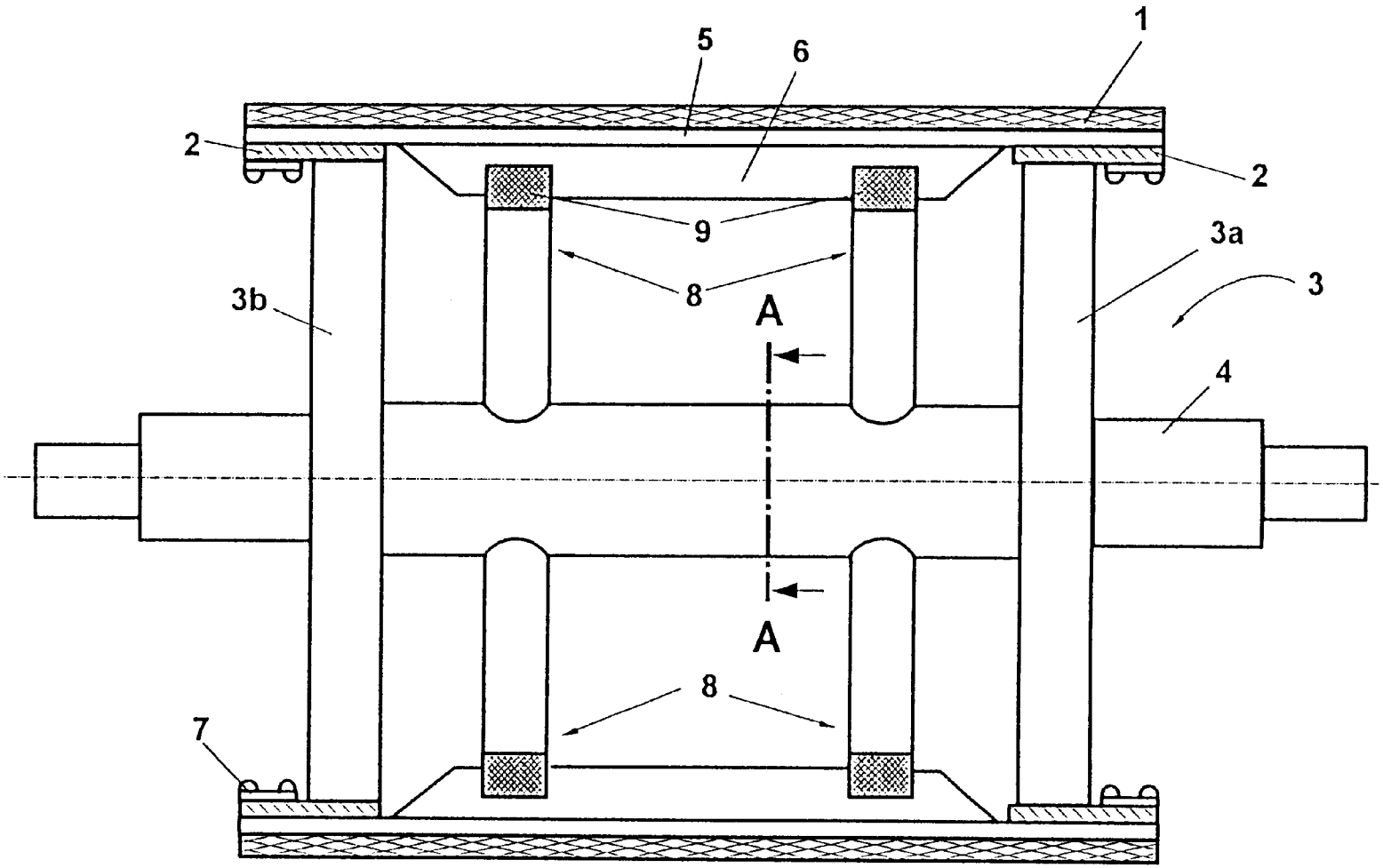
Figure 2:
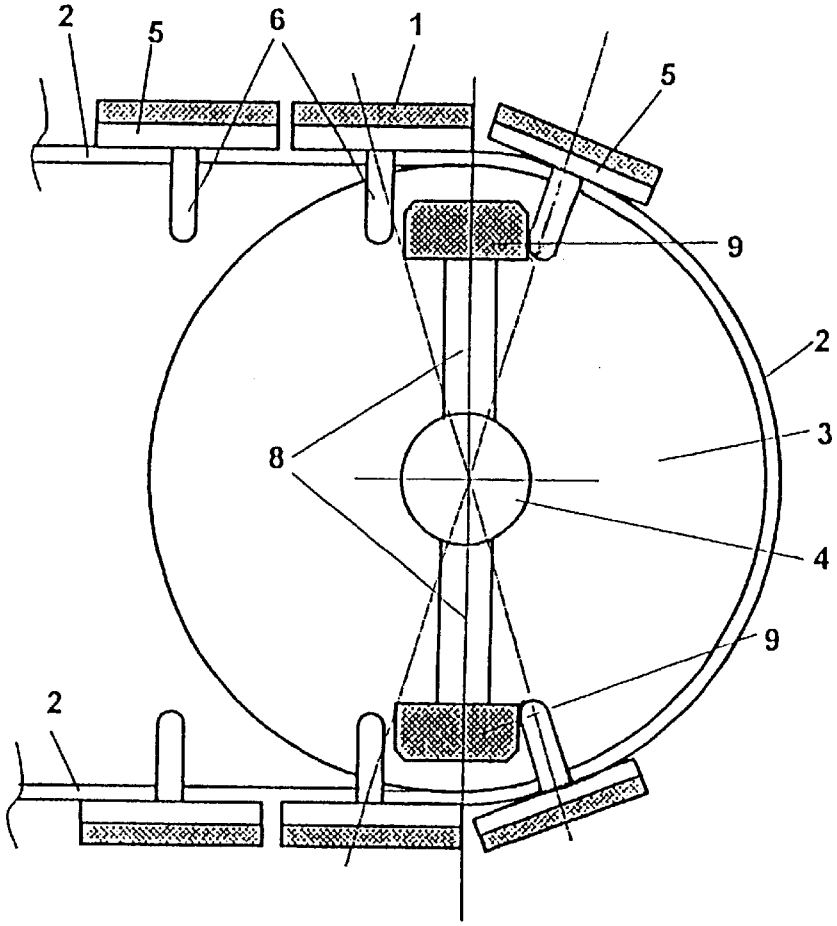
FIG. 2 shows a sectional detail view of the arrangement in FIG. 1 along line A—A.

Making reference to FIGS. 1 and 2, a first embodiment of the present invention is described. FIG. 2 shows a sectional detail view of the deflection area of a treadmill according to the present invention, in accordance with a section along A—A in FIG. 1. An endless belt 2 extends around the deflection pulley 3. Only one deflection pulley is shown. The belt runs over two such deflection pulleys which are arranged one behind the other with parallel axes. The deflection pulley 3 moves on a shaft 4. The belt 2 has attached thereto a plurality of tread lamellae 5 which can be covered with a coating 1 that can be implemented a shock-reducing coating consisting e.g. of rubber. In the present special embodiment, the individual tread lamellae are provided with a T-shaped cross-section. This cross-section increases the stability of the individual lamellae. The lower stems of these T-shaped tread lamellae serve as engagement elements, which will be described in detail hereinbelow. When the deflection pulley 3 is driven, the tread lamellae are advanced via the belt 2 and deflected by the deflection pulley 3. For the sake of clarity, FIG. 2 does not show all the tread lamellae on the belt.

In FIG. 1, the deflection area of a treadmill according to the present invention is shown at right angles to the axis of a deflection pulley. Identical elements are designated by identical reference numerals. The deflection pulley 3 consists of deflection disks 3*a* and 3*b*, which are fixedly connected to a deflection shaft 4. A flat belt 2, which is driven by the deflection disks, runs on each of said deflection disks 3*a*, 3*b*. This belt 2 has secured thereto the tread lamellae 5 by means of fastening screws 7. The stems 6, which serve as engagement elements, are only formed between the belts 2 and the deflection disks 3*a*, 3*b*, respectively. When the deflection shaft 4 is driven, the deflection disks 3*a*, 3*b* rotate and drive the tread lamellae 5 via the belt 2. In addition, stabilizers 8 are attached to the deflection shaft 4, said stabilizers 8 extending radially away from the deflection shaft 4. The length of these stabilizers 8 is of such a nature that the stabilizers are adapted to engage with the downwardly extending engagement elements 6 of the tread lamellae 5. In the engagement area 9 of the stabilizers 8, said stabilizers 8 are made from an elastic material or they are provided with an elastic coating so that the engagement takes place with the least possible noise. The engagement elements 6 of the tread lamellae 5 can also be coated with an elastic material. In FIG. 2, it can be seen that, in the cicumferential direction, the engagement areas 9 of the stabilizers 8 are dimensioned such that they precisely fit in between to engagement elements 6 of two neighbouring tread lamellae 5. This guarantees an optimum alignment of the tread lamellae 5.

When the treadmill is in operation, the engaging stabilizers 8 with the engagement areas 9 prevent the flat belt 2 from slipping through on the deflection pulley 3, since the stabilizers 8 are connected to the deflection shaft 4 such that they are secured against rotation relative thereto. In the embodiment shown, at least two respective stabilizers 8 are arranged in opposed relationship with each other so that at least one stabilizer will always be in engagement with the tread lamellae. For improving the efficiency, an arbitrary number of stabilizers can, however, be provided at various angular positions.

In addition, two stabilizer units along the shaft 4 are shown at the same angular position in the case of the embodiment shown. This guarantees an optimum straight orientation of the tread lamellae 5. If, however, only one stabilizer unit, which may consists of several stabilizers 8 at different angular positions, is provided along the shaft 4, the individual stabilizers 8 must have a width of such a nature that an optimum straight orientation of the lamellae 5 is guaranteed.

When this first embodiment of the treadmill according to the present invention is in operation, a possibly occurring slip between the belt 2 and the deflection pulley 3 is prevented by the engagement of the stabilizers 8. This guarantees a 100% reproducibility of the movement and permits a precise adjustment of the speed and a precise measurement of the simulated running distance. This new technology also guarantees the parallelism of the tread lamellae 5. Since no toothed-belt drive is provided, an arrangement of this type is characterized by a particularly silent mode of operation. In addition, the treadmill runs in a particularly quiet and uniform manner.

Figure 3:
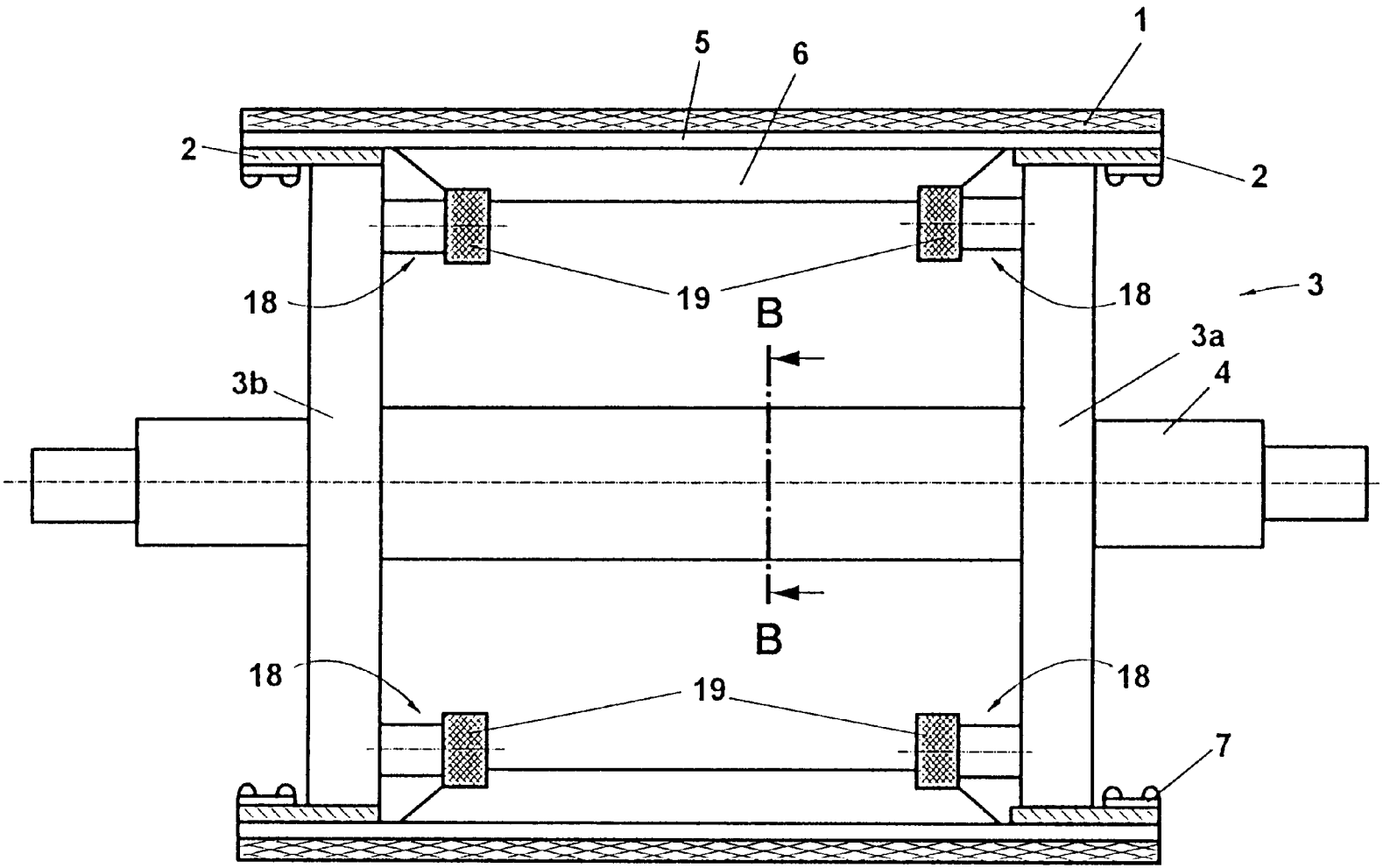
FIG. 3 shows the deflection area of a treadmill according to the second embodiment of the present invention.
Figure 4:
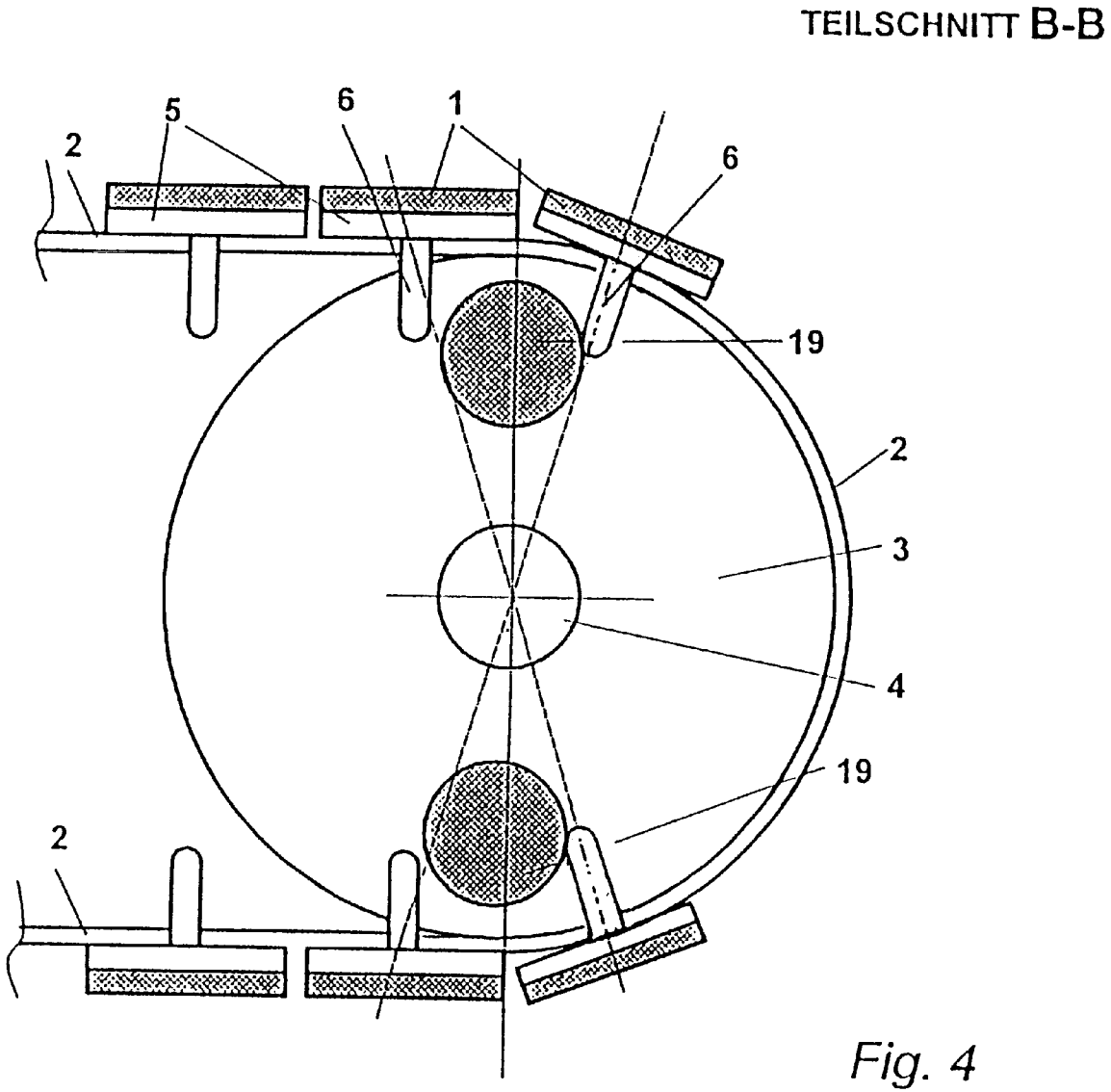
FIG. 4 shows a sectional detail view of the arrangement in FIG. 3 along line B—B.

FIGS. 3 and 4 show a second embodiment of the treadmill according to the present invention. Identical components are again provided with identical reference numerals. The stabilizers 18 extend parallel to the deflection shaft 4 and away from the deflection disks 3*a*, 3*b*. The engagement areas 19, in the embodiment shown the ends of the stabilizers 18, are again coated with elastic material. Two respective stabilizers 18 extend towards one another at the same angular position away from the deflection disks. The radius on the deflection disks 3*a*, 3*b* on which the stabilizers 18 are located is chosen such that the engagement areas 19 engage with the engagement elements 6 on the lower surfaces of the tread lamellae 5. The stabilizers 18 can be secured to the deflection disks 3*a*, 3*b* by means of screws or in some other way. FIG. 4 shows a sectional detail view of the second embodiment along line B—B in FIG. 3. The mode of operation of the second embodiment corresponds to that of the first embodiment. Due to the special arrangement of the stabilizers, it is, however, possible to reduce the weight and the amount of material used still further, whereby an even more quiet running will be guaranteed.

Figure 5:
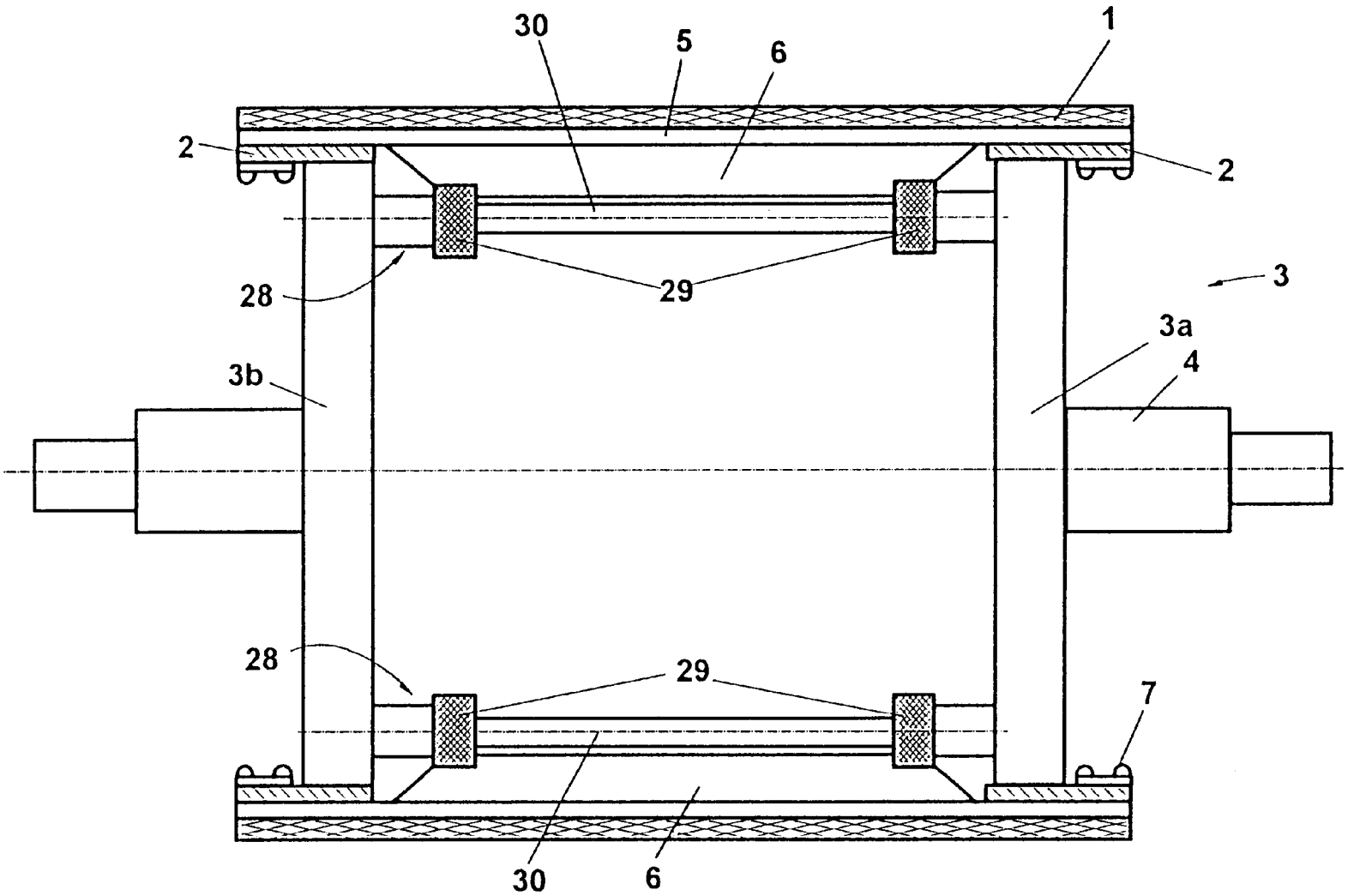
FIG. 5 shows a further embodiment of the present invention.

In FIG. 5, a further embodiment is shown, which is provided with stabilizers 28 corresponding to the stabilizers 18 of the second embodiment. The engagement areas 29 of the stabilizers 28 correspond to the engagement areas 19 of the stabilizers 18 of the second embodiment. A connection 30 is, however, additionally provided between two opposing stabilizers; said connection 30 can be implemented as a rod or as a tube. The two opposing stabilizers 28 and the connection 30 can also define a structural unit. Since two respective opposing stabilizers are interconnected in this way, the central shaft between the deflection disks 3*a*, 3*b* can be dispensed with. The mode of operation of this additional embodiment corresponds to that of the two above-mentioned embodiments.

It follows that a treadmill according to the present invention permits a 100% reproducibility of parameters, such as the simulated running distance, the speed and the force adjustment, since slip cannot occur between the belt 2 and the deflection pulley 3. Such slip is prevented due to the fact that stabilizers engage with the tread lamellae 5. The stabilizers also serve to maintain the individual tread lamellae 5 at positions at which they are parallel to each other. Since toothed belts and toothed rims on the deflection pulley can be dispensed with in accordance with the present invention, a particular silent and quiet operation is guaranteed.

What is claimed is:

1. A treadmill comprising at least one endless belt provided with a plurality of tread lamellae, the at least one endless belt is guided around two deflection pulleys which are arranged one behind the other with parallel axes, said deflection pulleys being smooth in the area where they are in contact with the belt and said at least one belt being implemented as a flat belt, wherein each tread lamella is provided with at least one engagement element projecting from the lower surface of said tread lamella, and that at least two stabilizers are provided, the stabilizers are connected to the deflection pulley such that the deflection pulleys are secured against rotation relative thereto, the stabilizer being in engagement with an engagement element on the lower surface of a tread lamella when the circumferential area of the deflection pulley, which rotates in synchronism with the stabilizer, is in contact with the at least one belt, and wherein at least one stabilizer being always in engagement with the engagement element of a tread lamella.

2. The treadmill of claim 1 wherein the deflection pulley comprises at least two deflection disks which are fixedly connected to a deflection shaft, wherein at least two belts running on the at least two deflection disks are provided, wherein the at least one engagement element projecting from the lower surface of a tread lamella is arranged between two belts, and wherein the at least two stabilizers are arranged between the deflection disks.

3. The treadmill of claim 2, wherein the tread lamellae between the belts have a T-shaped cross-section and wherein the downwardly projecting stem of this T-shaped cross-section constitutes the engagement element.

4. The treadmill of claim 1 wherein the stabilizers extend radially and have such a length that they are adapted to be brought into engagement with the engagement elements on the lower surface of the tread lamellae.

5. The treadmill of claim 1 wherein at least four stabilizers are provided, and wherein at least two respective ones of said stabilizers being arranged in spaced relationship with each other at the same angular position relative to the axis of the deflection pulley.

6. The treadmill of claims 2 or 3 wherein the stabilizers extend from a respective deflection disk parallel to the deflection shaft on a radius of the deflection disks which permits an engagement of the stabilizers with the engagement elements on the lower surfaces of the tread lamellae.

7. The treadmill of claim 6 wherein a respective stabilizer on a deflection disk is arranged in opposed relationship with a second stabilizer on another deflection disk.

8. The treadmill of claim 6 wherein the deflection disks are interconnected by the stabilizers.

9. The treadmill of claim 8 further including a central shaft between the deflection disks.

10. The treadmill of claim 1 wherein the stabilizers consist of an elastic material or are provided with an elastic coating in the area wherein the stabilizer is in engagement within the engagement elements on the lower surfaces of the tread lamellae.

11. The treadmill of claim 1 wherein the engagement elements on the lower surfaces of the tread lamellae are provided with a surface of elastic material.

12. The treadmill of claim 1 wherein in the circumferential direction of the deflection pulley, the size of the engagement areas of the stabilizers substantially corresponds to the distance between two engagement elements of two neighboring tread lamellae, when these two tread lamellae are positioned on the deflection pulley.

13. The treadmill of claim 1 wherein the stabilizers are arranged in pairs, the two stabilizers of one pair being arranged at opposite positions with regard to the axis of the deflection pulley.

* * * * *